US006354183B1

(12) United States Patent
Hallqvist

(10) Patent No.: US 6,354,183 B1
(45) Date of Patent: Mar. 12, 2002

(54) METHOD AND DEVICE FOR HANDLING PROPELLANT CHARGES OF DIFFERENT SIZES AND CHARGE STRENGTHS IN ARTILLERY GUNS

(75) Inventor: Sten Hallqvist, Vingåker (SE)

(73) Assignee: Bofors AB (SE)

( * ) Notice: Subject to any disclaimer, the term of this patent is extended or adjusted under 35 U.S.C. 154(b) by 0 days.

(21) Appl. No.: 09/297,931

(22) PCT Filed: Dec. 1, 1997

(86) PCT No.: PCT/SE97/02004

§ 371 Date: Jul. 19, 1999

§ 102(e) Date: Jul. 19, 1999

(87) PCT Pub. No.: WO98/25094

PCT Pub. Date: Jun. 11, 1998

(30) Foreign Application Priority Data

Dec. 2, 1996 (SE) ..... 9604418

(51) Int. Cl.[7] ..... F41A 9/00

(52) U.S. Cl. ..... 89/45; 89/33.02; 89/33.17; 89/46; 102/282

(58) Field of Search ..... 89/45, 46, 47, 89/33.01, 33.17, 33.1, 33.04, 33.05, 33.02

(56) References Cited

U.S. PATENT DOCUMENTS

| | | | | | |
|---|---|---|---|---|---|
| 341,371 | A | * | 5/1886 | Bruce | 89/33.17 |
| 2,587,672 | A | * | 3/1952 | Whitson | |
| 2,592,790 | A | * | 4/1952 | Brereton | |
| 4,388,854 | A | * | 6/1983 | Dabrowski et al. | 89/46 |
| 4,538,724 | A | | 9/1985 | Johnson | 206/3 |
| 4,702,167 | A | * | 10/1987 | Reinelt et al. | 102/282 |
| 5,111,730 | A | | 5/1992 | Grabner | 89/45 |
| 5,111,731 | A | | 5/1992 | Grabner | 89/46 |
| 5,282,423 | A | * | 2/1994 | Sikorski et al. | 102/282 |
| 5,337,649 | A | * | 8/1994 | Franzen et al. | 89/45 |
| 5,347,911 | A | * | 9/1994 | Hallqvist | 89/45 |
| 5,458,044 | A | | 10/1995 | Delbos | 89/33.1 |
| 5,675,109 | A | * | 10/1997 | Maher | 89/33.01 |
| 5,831,201 | A | * | 11/1998 | Andersson et al. | 89/47 |
| 6,026,729 | A | * | 2/2000 | Hallqvist | 89/46 |

FOREIGN PATENT DOCUMENTS

| | | | |
|---|---|---|---|
| AU | 713128 | * 10/1941 | 89/33.17 |
| DE | 24 13 983 | 10/1979 | |

* cited by examiner

*Primary Examiner*—Michael J. Carone
*Assistant Examiner*—Denise Buckley
(74) *Attorney, Agent, or Firm*—Connolly Bove Lodge & Hutz LLP

(57) ABSTRACT

The present invention relates to a method and a device for use in gun magazines first and foremost in automatic-loading artillery guns (26) for arranging and stowing modular charges, and for delivering the desired number and type of modular charge (50, 51, 53–55) for each loading occasion that may involve different charge strengths such as different lengths and diameters but which may be combined in the desired manner for each individual occasion to impart the correct performance to projectiles fired from the artillery gun.

8 Claims, 5 Drawing Sheets

Figure 4:
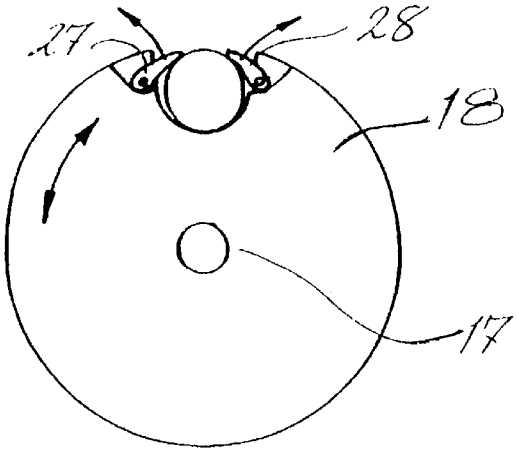

METHOD AND DEVICE FOR HANDLING PROPELLANT CHARGES OF DIFFERENT SIZES AND CHARGE STRENGTHS IN ARTILLERY GUNS

The present invention relates to a method and a device for use in gun magazines first and foremost in automatic-loading artillery guns for arranging and stowing modular charges, and for delivering the desired number and type of modular charge for each loading occasion that may involve different charge strengths such as different lengths and diameters but which are all enclosed in combustible outer casing of known type and which may be combined in the desired manner for each individual occasion to impart the correct performance to projectiles fired from the artillery gun.

It is already possible using artillery locating radar and other surveillance systems, for example, to determine rapidly and with high precision the location of an artillery gun that has opened fire. There is thus a good opportunity for an enemy to open effective counter-battery fire. The artillery has therefore more or less been forced to depart from its previously fairly stationary tactics in favour of significantly more mobile tactics involving rapid engagements in the form of short intensive fires followed by immediate redeployment to a pre-determined deployment site at a sufficiently safe distance from the previous one. These new tactics have resulted in an increased need for every gun to be self-propelled and capable of carrying at least a primary requirement of ammunition.

Originally, bag charges—more or less rigid propellant charges sewn into fabric bags or sacks—were used as propellant charges for artillery ammunition in which the propellant charge and projectile were not fixed together by means of a cartridge case at the moment of loading. Bag charges were difficult to use in fully automatic loading systems even though they could, by using a certain artifice, be automatically rammed.

Bag charges will gradually be replaced by combustible cases that are easier to load automatically. However, for the artillery of the future it is expected that different types of mutually combinable modular propellant charges enclosed in combustible, and preferably rigid outer casing, will in combination with each other provide charge units that are well suited to automatic loading. Since these modular charges may be of various sizes as well as consist of different types of propellant and, moreover, can be combined in various quantities it enables a very large freedom of choice when selecting projectile trajectory and time of flight for each individual round.

Because the modular charges of the above mentioned general type each constitute a rigid unit they are well suited to being handled mechanically in a fully automatic loading system, and the fact that in each specific case it is necessary to feed the correct number and types of modular charge makes such a dedicated loading system somewhat complex.

An example of a previous variant and a device for arranging propellant charges of the general type described herein for automatic loading is described in WO96/07865. The device described therein comprises a patemoster conveyor with many movable parts and a transport pendulum that has to change the angle of the stowed charge from vertical to almost horizontal before loading of the artillery gun in question could be effected. Furthermore, the device described therein can only handle modular charges of a limited number of lengths. In addition, consideration must be given in future artillery systems to the fact that the guns in question must be equipped with overall fragment protection which thus necessitates very compact systems.

The purpose of the present invention is to offer a new method and a new device for arranging and stowing and for supplying the desired quantity and types of modular charge of general type indicated above for each loading occasion. The distinguishing features of the method and device for the present invention are that one thereby achieves an enhanced stowage density for the modular charges with resultant larger capacity or more compact space requirement while the number of moving parts has been significantly reduced and handling routes simplified. Altogether this provides a larger magazine capacity and enables more rapid loading operations. Moreover, the device in the present invention can also handle modular charges of slightly different diameters.

Hallmarks of the present invention are how stowage is arranged of the modular charges necessary for composition into complete propellant charges and how the modular charge magazines are designed, as well as how the modular charges necessary for each complete propellant charge are collected from their respective locations in the magazine and how these are combined into a complete propellant charge plus the devices required for this.

The present invention enables modular charges of the same strength, i.e. containing the same type of propellant and being of the same length and diameter, to be stowed horizontally end-on-end in special magazine tubes arranged in groups around a parallel axis. Each such group—called a revolver magazine module—is revolvable around its own axis. This is to enable any magazine tube to revolve until aligned with the outfeed aperture for the magazine module in question. In the opposite end of the magazine tube from the outfeed aperture there is either an ejector for each magazine tube in the magazine module, or a common ejector for the revolver magazine module, by means of which the number of modular charges commanded can be ejected from the magazine tube in question.

The number of magazine tubes per revolver magazine module may vary but four magazine tubes should probably be an appropriate number. With, for example, four or more such revolver magazine modules arranged in parallel with each other and at such a distance from each other that the outfeed apertures of each revolver magazine module are available for one and the same transport device or outfeed unit by means of shifting between the outfeed apertures of each revolver magazine module, the transport device or outfeed unit can be made to fetch the various modular charges from each outfeed until the desired complete propellant charge has been assembled, after which directly, or via a special loading pendulum as an intermediate function, the complete propellant charge can be rammed in the artillery gun in question.

The present invention also includes several variants concerning how the number of modular charges is determined that on each individual occasion are retrieved from each magazine tube. The basic principle is that the number of modular charges to be retrieved from each magazine tube for each complete propellant charge shall be determined by the space made available on each retrieval occasion by the outfeed unit for receiving modular charges.

In the first variant the outfeed unit is in the form of several disks of identical size individually rotatable around a common axis, the thickness of each disk equating to the length of the shortest modular charge that is to be handled. The rotation axis of the disks is parallel to the revolver axis of the revolver magazine modules. Each disk has at least one aperture that accommodates one modular charge. By rotating the disks around the common axis all these apertures can be precisely aligned with each other, alternatively the alignment procedure can be discontinued so that the number of apertures aligned with each other can be varied from one to the maximum number of disks. Further, the apertures and common axis of the disks are so arranged relative to the outfeed apertures of the relevant magazine tubes that the apertures of the disks can be rotated in turn to align with the outfeed aperture of the relevant magazine tube. In this position the number of modular charges equivalent to the number of disk outfeed apertures aligned are pushed from the magazine tube apertures into the respective disk apertures by the co-ordinated ejector. Thus if the outfeed unit formed by the disk apertures aligned with each other is to receive a modular charge whose length corresponds to the length of several modular charges the corresponding number of disk apertures must be available.

After retrieving the correct number of modular charges from the first revolver magazine module the required number of disks in the disk outfeed unit rotate so that the correct number of disk apertures are aligned corresponding to the number of modular charges to be retrieved. These new modular charges are subsequently pushed over into the outfeed unit while the previously retrieved modular charges already lying there are pushed further into the unit.

When all the modular charges required have been retrieved the outfeed unit moves to the position in which the now complete propellant charge is transferred directly to the loading pendulum either longitudinally or laterally, or indirectly via another transport device. From the loading pendulum there is either direct transfer to the breech opening of the gun or indirect transfer via a separate loading tray. To enable the outfeed unit to be emptied laterally it is necessary for its disk apertures to be open radially outwards so that the complete propellant charge can be transferred radially to the side. In any case it probably requires some sort of ejector but these could be technically very elementary which is why their practical design is omitted herein.

In another variant the previously described disks are replaced by a corresponding number of ribbon outfeeds, each of which incorporates a tubular chamber—an for one modular charge— that is indexed by the ribbon feed between the outfeed apertures of the various revolver magazine modules and a corresponding communication location for transfer of the complete propellant charge direct to the gun or via a loading pendulum. A stop plate can be mounted on the side of each outfeed chamber as stops when the outfeed chambers are not aligned with each other.

Figure 1:
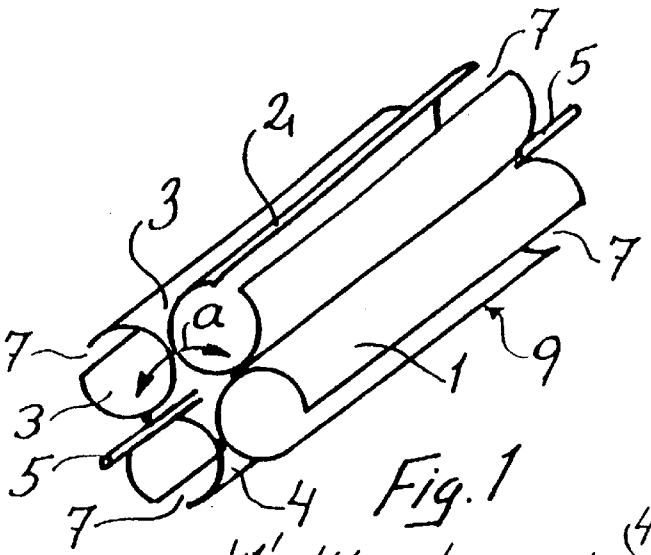

The present invention is defined in the Patent claims below, and shall now be described in more detail with reference to the appended figures:

FIG. 1 a diagonal projection of the basic design of the propellant magazine as defined in the present invention.

Figure 7:
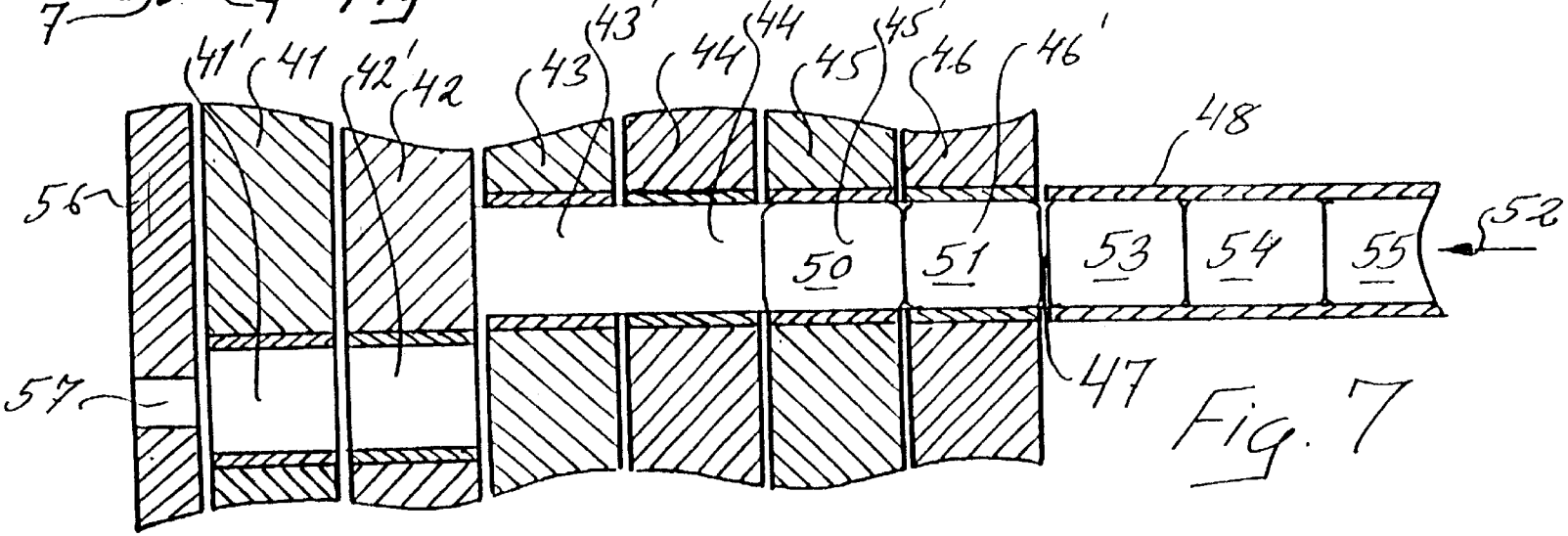
Figure 2:
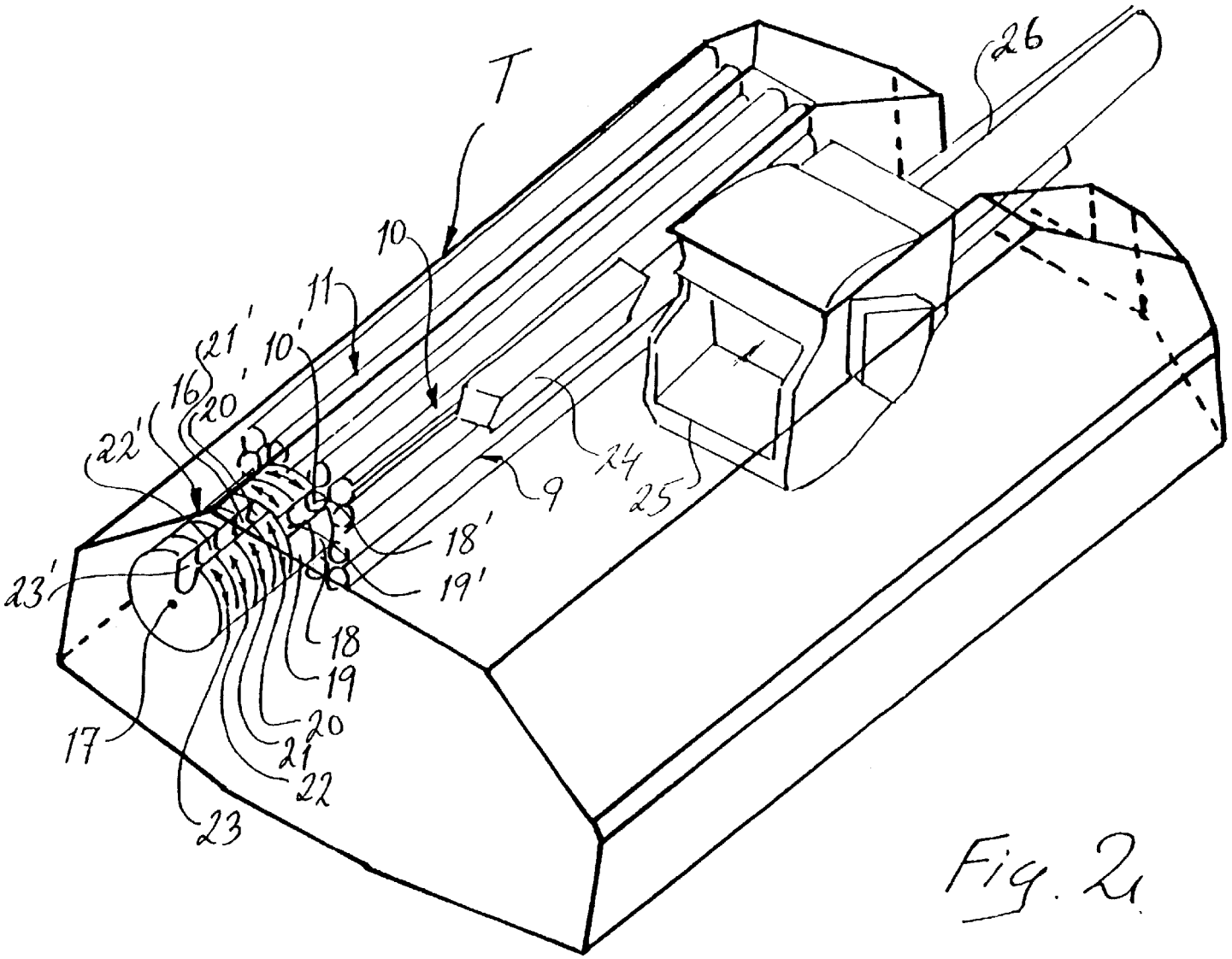
Figure 3:
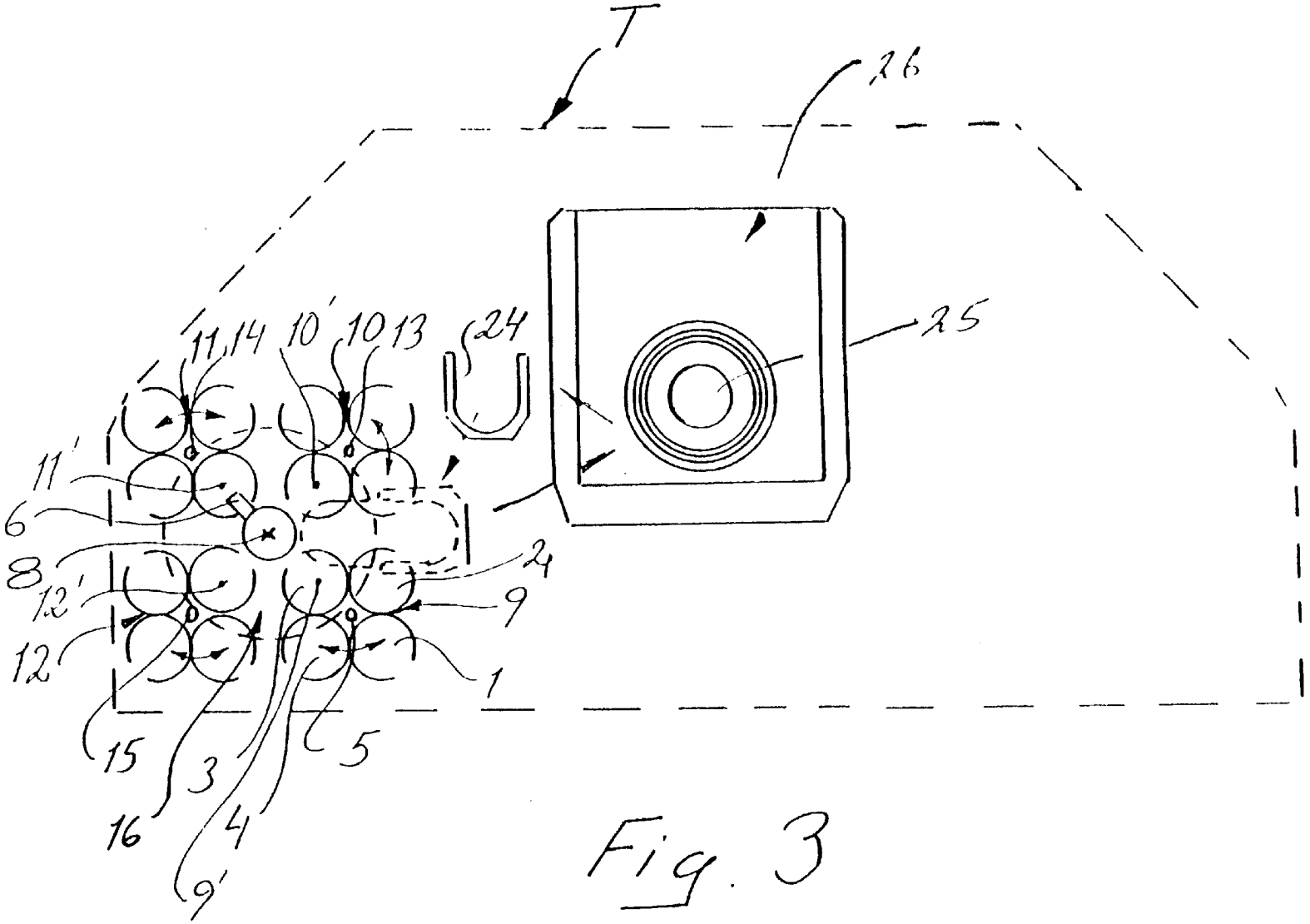
Figure 5:
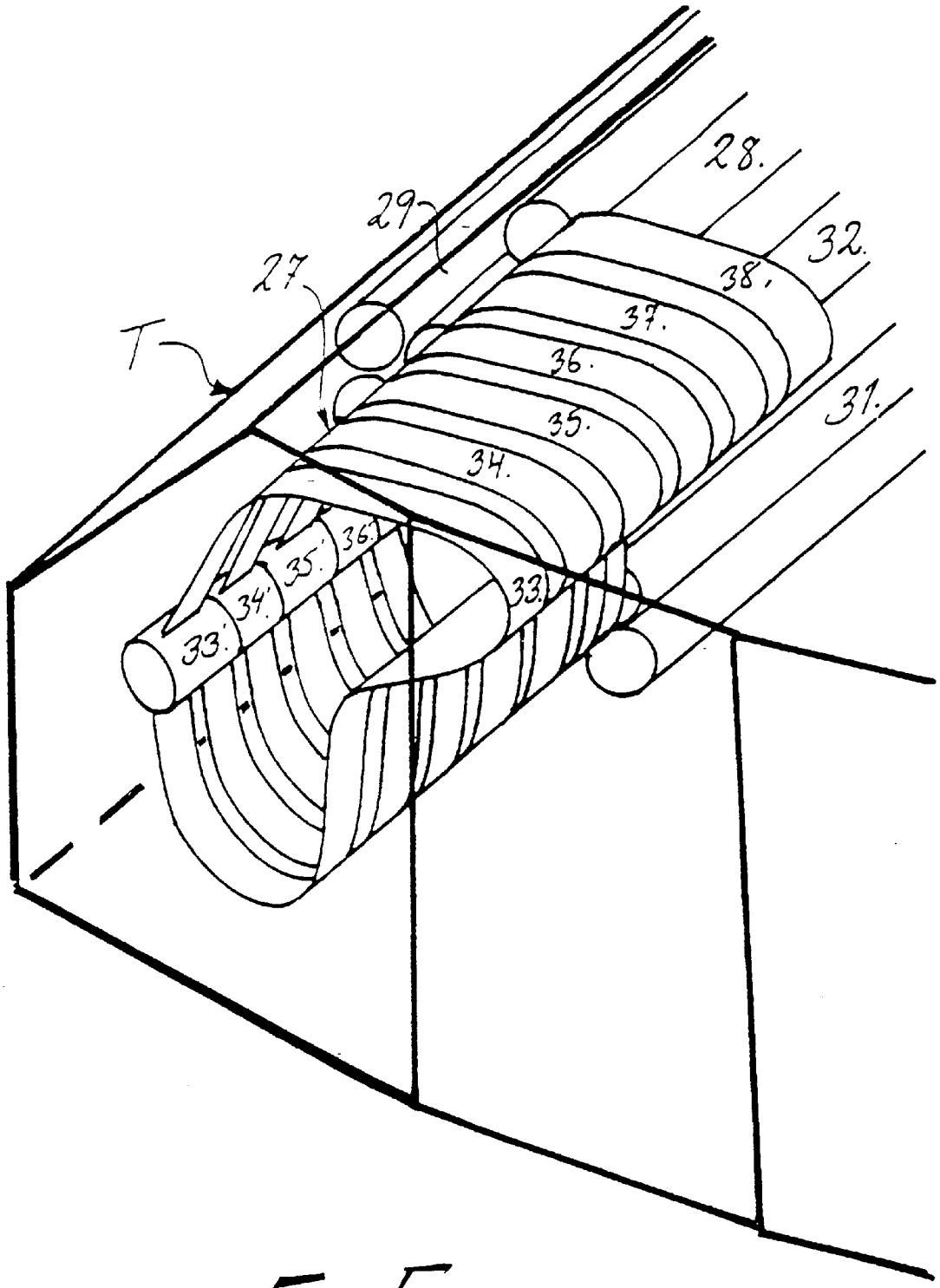
Figure 6:
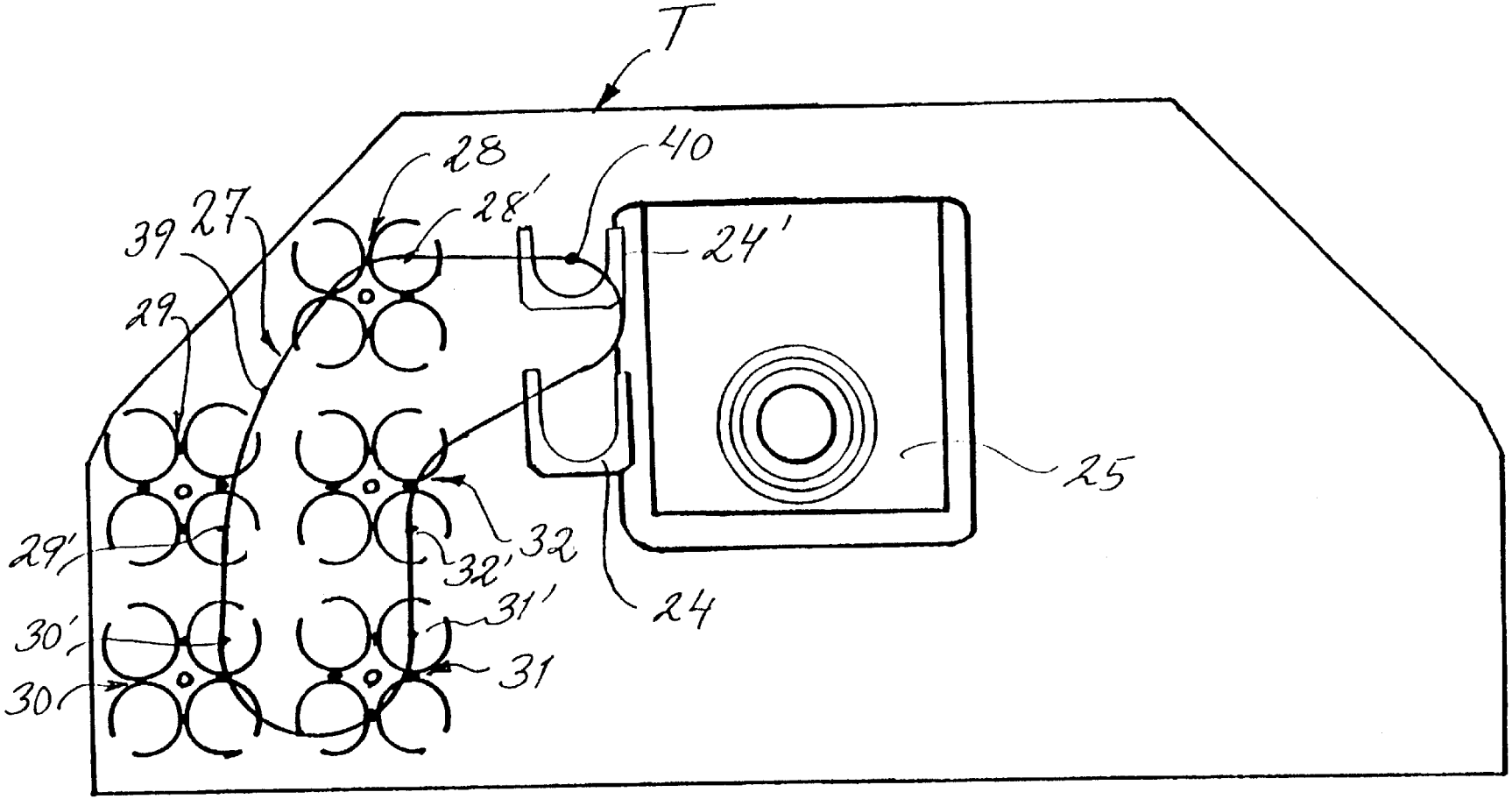

FIG. 2 an exploded section of a small scale diagonal projection of an artillery gun mounted in an armoured turret equipped with a variant of the automatic loading system as defined in the present invention, FIG. 3 section through the same armoured turret as in FIG. 2, but viewed from the rear and to a larger scale, FIG. 4 close-up of a disk as visible in FIGS. 2 and 3, FIG. 5 a larger scale exploded section of the same armoured turret shown in FIG. 2 but here equipped with a variant of the outfeed system incorporated in the automatic loading system as defined in the present invention, FIG. 6 the same section as shown in FIG. 3 but with the automatic loading system shown in FIG. 5, FIG. 7 a larger scale diagram showing the principle of the distinguishing feature that on each outfeed occasion determines the number of modular charges retrieved.

Parts shown as generally unchanged on several figures naturally have the same designation on each figure even though the scales used are different and the degree of detail varies.

For the sake of clarity all parts in FIG. 2 relating to the gun mount and laying equipment (elevation and traverse) have been excluded.

For the same reason the parts of the automatic loading system relating to the handling of projectiles that in reality will be mounted in the opposite compartment of the turret, T, have also been omitted from this figure.

The basic principle of the magazine as defined in the present invention is the magazine module revolvable around a common axis that, for example, may comprise four such magazine tubes as illustrated in FIG. 1 and which is wholly or partially shown in FIGS. 2, 3, 5 and 6.

Each such magazine tube is in turn filled with modular charges of one and the same propellant strength, i.e. containing the same type of propellant and of the same length. Minor variations in the diameters of the modular charges can, however, be handled in the same magazine tube.

The revolver magazine module comprises four interlinked magazine tubes, 1–4, arranged in parallel with each other. As shown by arrow 'a' in FIG. 1 these are journal to be revolvable around a common axis 5 which is also parallel to the magazine tubes. As shown in the figure the magazine tubes 1–4 each incorporate a longitudinal slot 7. This is to enable the ejector common to all the revolver magazine modules, designated 6 in FIG. 3, to operate in all the magazine tubes. With a different type of ejector operating from the opposite end to the outfeed apertures of the magazine tubes the magazine tubes 1–4 could be manufactured without these slots. Such an ejector could, for example, be driven by compressed air.

Four or more of these revolver magazine modules, designated 9, 10, 11 and 12 in FIGS. 2 and 3, are co-ordinated in the manner shown in FIG. 3, i.e. they are arranged around a common central axis 8. Each such revolver magazine module is in turn revolvable around its respective axis (designated 5, 13, 14 and 15 in FIG. 3).

Each revolver magazine module (9–12) also has its own outfeed positions 9'–12' that are all located equi-distant from the joint axis 8 of the revolver magazine modules.

At the outfeed end of the magazine tubes, which may also be the same end as that through which the magazine tubes are replenished when required there is an outfeed unit 16, which in the case shown in FIG. 2 consists of six disks 18–23 individually rotatable around a common pivot 17. Pivot 17 is aligned with the previously mentioned fixed axis 8 for all four revolver magazine modules.

In the variant shown in FIG. 4 each disk has an outfeed aperture or opening 18'–23'. In the setting shown in FIG. 2 outfeed apertures 18' and 19' are rotated to be aligned with each other and in line with outfeed 10' of magazine tube 10 while the other disk outfeed apertures are rotated away from outfeed 10'. Thus in the example shown modular charges of a length equal to the combined thickness of both disks can be transferred into the combined space formed by disk outfeed apertures 18' and 19', i.e. two modular charges of the shortest length or one modular charge of double the shortest length.

In this position it is thus the task of ejector 6 to transfer the relevant modular charges into the space provided by the outfeed unit 16. As indicated in FIG. 3 this ejector may consist of a dog that runs in the slot 7 of the magazine tube in question projecting into the magazine tube. The ejector may consist of a compressed air driven piston, for example, operating from the opposite end of the magazine tube, or the ejector may be in the form of direct-acting compressed air.

As soon as this is completed the required number of disks in the outfeed unit 18–23 rotate to the next revolver magazine module outfeed position where a further number of outfeed apertures equivalent to the number of modular charges to be retrieved are aligned with 18' and 19' after which the procedure of transferring these additional modular charges is performed in a similar manner by the same ejector 6 thus pushing the previously retrieved modular charges to the end of the outfeed unit. The same procedure is then performed for the two remaining revolver magazine modules after which the outfeed unit 16 is rotated so that all the outfeed apertures filled with modular charges assume the position indicated by the broken line in FIG. 3 where the now complete propellant charge can be transferred by an ejector that is not illustrated into the loading pendulum 24 to be subsequently either directly, or indirectly via a loading tray, transferred into the breech opening 25 of the gun 26.

The figures do not show in detail how rotation of the 6 disks in the outfeed unit is arranged, nor how the revolver magazine modules in the propellant magazine are revolver but it is presupposed that all this is performed by individually controllable electric motors whereby those incorporated in the outfeed unit may be assumed to be mounted inside their respective disks.

As stated above, the example shown presupposes that the outfeed apertures 18'–23' of the outfeed unit are filled from the front but are emptied to the side. This is, however, only a conceivable variant since emptying even into the loading pendulum or other transporter could also be performed forwards, rearwards or upwards.

When emptying to the side, upwards or downwards, i.e. radially, some kind of retainer is required to secure the modular charges in position in the outfeed apertures of the disks until it is time to transfer the modular charges onto the loading tray.

An example of such retainers in the form of movable pawls that open at the right time are illustrated in FIG. 4 where the pawls are designated 27 and 28.

In the event that emptying of the outfeed unit can be performed axially, i.e. forwards or rearwards, the outfeed apertures of the disks are probably constructed as through-holes.

In the variant shown in FIGS. 5 and 6 the propellant magazine is constructed of the same basic components as in the previous variant, namely revolver magazine modules each comprising four magazine tubes, but as illustrated primarily in FIG. 6 there is in this case a special design of the outfeed unit, here designated 27, that enables space for five revolver magazine modules 28–32 each containing four magazine tubes. The outfeed positions of these revolver magazine modules are designated 28'–32'.

In this variant the outfeed unit is in the form of a number of ribbon outfeeds (the example shown in the figures has six) 33–38 that follow the curved path, designated 39 in FIG. 6, between the outfeed positions 28'–32' of the revolver magazine modules plus a transfer position 40 for transferring the retrieved complete propellant charge to the loading pendulum 24.

The basic idea behind the design shown in FIG. 5 is that each ribbon outfeed 33–38 incorporates an outfeed chamber 33'–38' each of which accommodates one modular charge of shortest length. In FIG. 5 only outfeed chambers 33'–36' are visible.

The operating principle for the device is thus the same as that described for FIGS. 2 and 3. By selecting the number of outfeed chambers that shall be aligned with each other in line with each outfeed position the number of modular charges that can be transferred into the outfeed unit from each magazine tube is determined in an elementary manner.

Another advantage of this variant is that the greater mobility of the ribbon outfeeds in the outfeed unit enables all the outfeed chambers to pass immediately behind the raised loading pendulum 24' after which all the modular charges in the ribbon outfeed chambers can be transferred by a single ejector into the loading pendulum from which they can be directly transferred to the breech opening 25 of the gun 26 for ramming into the breech chamber.

This variant is thus considerably more flexible even though it requires more moving parts than the variant illustrated in FIG. 2.

All parts relating to the rotation and journalling of the ribbon outfeed unit have been omitted herein as their inclusion would make the figures too cluttered and indistinct.

Finally, FIG. 7 shows the retrieval system for both the variants previously illustrated. The six disks or ribbon outfeeds 41–46 incorporating outfeed chambers 41'–46' are shown. Outfeed chambers 45' and 46' each retrieved a modular charge 50 and 51 at a previous outfeed position at a previous revolver magazine module. When indexing to outfeed position 47 relating to magazine tube 48 as shown in the figure, outfeed chambers 43' and 44' have been aligned with 45' and 46' and these four outfeed chambers are in turn aligned with magazine tube 48.

An ejector indicated by arrow 52 can now push two more modular charges 53 and 54 into the outfeed chambers 45' and 46'. As this occurs modular charges 50 and 51 are pushed into outfeed chambers 43' and 44'.

Disk or ribbon outfeed unit 42 thus functions as a stop. Outfeed chambers 41' and 42' are thus available for the next outfeed position.

In the example shown there is also a stop disk 56 mounted behind outfeed chambers 41' and 42'. The stop disk may also incorporate an opening 57 for an ejector that is to be actuated when the complete propellant charge shall be transferred to loading pendulum 24.

What is claimed is:

1. A method for arranging, stowing and retrieving modular charges of a given quantity and propellant strength for delivery to an artillery gun comprising the steps of stowing modular charges having a similar type of propellant and length end-to-end within a plurality of horizontal tubes of a rotatable magazine module with the tubes arranged adjacent and parallel to one another, selectively rotating the tubes of the magazine module about a centrally positioned horizontal axis to a common outfeed position, and retrieving modular charges from selective tubes at the outfeed position for transport to the artillery gun, and further including the step of arranging four rotatable magazine modules in a circle, and selectively rotating the magazine modules about a centrally positioned horizontal axis so as to position the tubes of the magazine modules at the common outfeed position of each modular magazine, and retrieving modular charges from selected tubes of each magazine module at the common outfeed position of each modular magazine for transport to the artillery gun.

2. A method for arranging, stowing and retrieving modular charges of a given quantity and propellant strength for delivery to an artillery gun comprising the steps of stowing modular charges having a similar type of propellant and length end-to-end within a plurality of horizontal tubes of a rotatable magazine module with the tubes arranged adjacent and parallel to one another, selectively rotating the tubes of the magazine module about a centrally positioned horizontal axis to a common outfeed position, and retrieving modular charges from selective tubes at the outfeed position for transport to the artillery gun, and wherein the quantity of modular charges retrieved from each tube at the common outfeed position is determined by the length of a space in an outfeed unit aligned with the tube and available to receive retrieved modular charges.

3. A method as claimed in claim 2 including the step of controlling the length of the space of the outfeed unit aligned with the tube and available to retrieve modular charges to thereby control the quantity of modular charges retrieved from the common outfeed position of the tubes.

4. Apparatus for arranging, stowing and retrieving modular charges of a given quantity and propellant strength for delivery to an artillery gun comprising at least one magazine module having a plurality of tubes arranged adjacent and parallel to one another, modular charges stowed in each tube, means for selectively rotating the magazine module about a horizontal axis centrally located with respect to the plurality of tubes to position the tubes at a common outfeed position, and an ejector constructed and arranged to retrieve modular charges from each tube when positioned at the common outfeed position for delivery to the artillery gun.

5. Apparatus as claimed in claim 4 including an outfeed unit in alignment with the common outfeed position of the magazine module for receiving modular charges from the tubes of the magazine module.

6. Apparatus as claimed in claim 4 including a plurality of magazine modules each having a plurality of tubes adjacent and parallel to one another with modular charges stowed in each tube, means for rotating each magazine module about a horizontal axis centrally located with respect to the plurality of tubes comprising that magazine module, and wherein the ejector is constructed and arranged to retrieve modular charges from each tube of each modular magazine for delivery to the artillery gun.

7. Apparatus as claimed in claim 5 wherein the outfeed unit comprises a plurality of disks journalled on and rotatable about a common central axis, each disk having an outfeed aperture for receiving a module charge, and means for selectively rotating the disks to selectively position predetermined outfeed apertures in alignment with one another.

8. Apparatus as claimed in claim 5 wherein the outfeed unit comprises a plurality of ribbon outfeeds each having an outfeed chamber.

* * * * *